US006068445A

United States Patent [19]

Beeck et al.

[11] Patent Number: 6,068,445

[45] Date of Patent: May 30, 2000

[54] COOLING SYSTEM FOR THE LEADING-EDGE REGION OF A HOLLOW GAS-TURBINE BLADE

[75] Inventors: Alexander Beeck, Kússaberg, Germany; Bruce Johnson, Untersiggenthal, Switzerland; Bernhard Weigand, Waldshut-Tiengen, Germany; Pey-Shey Wu, Chiai, Taiwan

[73] Assignee: ABB Research Ltd., Zurich, Switzerland

[21] Appl. No.: 09/111,706

[22] Filed: Jul. 8, 1998

[30] Foreign Application Priority Data

Jul. 14, 1997 [EP] European Pat. Off. ..... 97810474

[51] Int. Cl.[7] ..... F01D 5/18

[52] U.S. Cl. ..... 416/96 R; 416/96 A; 416/97 A

[58] Field of Search ..... 416/96 R, 96 A, 416/97 A; 415/115

[56] References Cited

FOREIGN PATENT DOCUMENTS

| | | |
|---|---|---|
| 0230917A2 | 8/1987 | European Pat. Off. . |
| 0527554A1 | 2/1993 | European Pat. Off. . |
| 3248162C2 | 7/1983 | Germany . |
| 2112467A | 7/1983 | United Kingdom . |
| 2159585A | 12/1985 | United Kingdom . |

OTHER PUBLICATIONS

"Augmented Heat Transfer in Triangular Ducts with Full and Partial Ribbed Walls", Zhang, et al., Journal of Thermophysics and Heat Transfer, vol. 8, No. 3, Jul.–Sep. 1994, pp. 574–579.

*Primary Examiner*—Edward K. Look
*Assistant Examiner*—Rhonda Barton
*Attorney, Agent, or Firm*—Burns, Doane, Swecker & Mathis, L.L.P.

[57] ABSTRACT

In a cooling system for the leading-edge region of a hollow gas-turbine blade, a duct (3), through which flow occurs longitudinally, extends from the blade root up to the blade tip and is defined in the region of the blade body (4) by the inner walls of the leading edge (5), the suction side (6) and the pressure side (7) and by a web (8). The inner walls of the suction side and the pressure side are provided with a plurality of ribs (9), which run slantwise and at least approximately in parallel. The suction-side ribs and the pressure-side ribs are offset from one another over the blade height. The ribs (9) run radially inward from the web (8) in the direction of the leading edge (5), merge into the radial in the region of the leading edge and are led around the leading edge. The deviation of the ribs (9) from the slant into the radial is effected with the smallest possible radius. The ratio of the height (h) of the ribs (9) to the local height (H) of the duct (3) is constant over the longitudinal extent of the ribs.

9 Claims, 2 Drawing Sheets

COOLING SYSTEM FOR THE LEADING-EDGE REGION OF A HOLLOW GAS-TURBINE BLADE

BACKGROUND OF THE INVENTION

1. Field of the Invention

The invention relates to a cooling system for the leading-edge region of a hollow gas-turbine blade, in which a duct, through which flow occurs longitudinally, extends from the blade root up to the blade tip and is defined in the region of the blade body on the one hand by the inner walls of the leading edge, the suction side and the pressure side and on the other hand by a web connecting the pressure side to the suction side, the inner walls of the suction side and the pressure side being provided with a plurality of ribs, which run slantwise and at least approximately in parallel, and the suction-side ribs and the pressure-side ribs being offset from one another over the blade height.

The invention therefore relates very generally to a system for cooling a curved wall, around which hot medium flows on one side and a cooling medium flows on its other side.

2. Discussion of Background

Hollow, internally cooled turbine blades with liquid, steam or air as cooling medium are sufficiently known. In particular, the cooling of the leading-edge region of such blades poses a problem.

DE-C2 32 48 162 discloses a cooling system of the aforementioned type. The inner walls of the region considered are equipped with ribs, which run radially outward from the leading edge right up to the web. These ribs have a height which at each point is between 10% and 33% of the local height of the cooling-medium duct. Thus the leading-edge region is supposed to be effectively cooled even in the case of a narrow duct. Here, the ribs are provided in order to initiate and encourage turbulence, and the cooling fluid is said to be directed through the blade without great resistance. Vortices which have a velocity component toward the leading edge are supposed to develop due to the slanting arrangement of the ribs in a defined direction. This is supposed to lead to the cooling medium being deflected as a body toward the leading-edge region, whereby this region is effectively cooled even without film cooling. To this end, the actual leading edge is constructed so as to be free of ribs. On the inside, it has a cylindrical shape with a radius which corresponds approximately to the height of the adjoining ribs. The distance of the ribs from the leading edge is between one to five times the rib height.

Further considerations as to how the heat transfer can be improved by means of ribs in so-called triangular ducts—as represented by the leading-edge region of a gas-turbine blade—are set forth in the Journal of Thermophysics and Heat Transfer, Vol. 8, No. 3, July–September 1994, on pages 574–579 in an article by Zhang et al.

However, the problem with the triangular ducts equipped with ribs of the same height is that, due to the large cross section at the base of the triangle, an excessive quantity of cooling medium flows through there as a result of the lower resistance, a fact which may lead to the shortcomings mentioned below.

SUMMARY OF THE INVENTION

Accordingly, one object of the invention is to provide a novel cooling system of the type mentioned at the beginning in which a considerable increase in the coefficient of heat transfer can be achieved by increasing the turbulence in the leading-edge region and by further measures.

It is especially expedient if the ratio of the height of the ribs to the local height of the duct increases from the leading edge in the direction of the web or is constant over the longitudinal extent of the ribs. With this measure, a cross section having at least approximately the same obstruction and thus uniform flow distribution can be achieved in every radial plane from the leading edge up to the web. This has the advantage that, compared with the prior art mentioned at the beginning, the leading edge is acted upon to a greater extent and at the same time the web is relieved. The latter is important in order to avoid excessive stresses at the connecting points, on both sides, between the cool web and the hot blade walls.

Further relief of the web region is achieved when—again in contrast to the prior art mentioned at the beginning—the height of the ribs in the region of the web is reduced at an early stage in such a way that the rib does not extend to the web. The turbulence, which is then lacking in this region, brings about advantageous reduced cooling of the web in the connecting region.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of an internally cooled gas-turbine blade, wherein.

DESCRIPTION OF THE PREFERRED EMBODIMENTS

Figure 1:
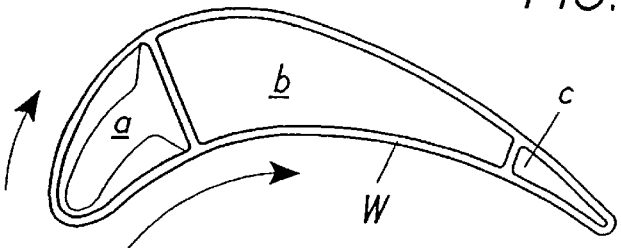
FIG. 1 shows a blade in cross section.

Referring now to the drawings, wherein like reference numerals designate identical or corresponding parts throughout the several views, only the elements essential for an understanding of the invention are shown, and the direction of flow of the media involved is designated by arrows, the cast blade shown in FIG. 1 has three inner chambers a, b and c, through which a cooling medium, for example steam or air, flows perpendicularly to the drawing plane. In this case, the cooling medium flows around the insides of the wall W, which forms the blade contour and around which hot gases flow on the outside on either side, the insides of said wall W giving off their heat to the cooling medium. As a rule, numerous aids (not shown here) such as guide ribs, flow ducts, inserts for impingement cooling and the like may be provided, at least in the two leading chambers a, b in order to improve the wall cooling. In the example, the cooling medium circulates in closed circuit, which refers to the fact that cooling medium is not blown out into the flow duct at the leading edge, the suction side, the pressure side or in the region of the trailing edge.

There are two problem regions in the leading chamber a. On the one hand, the actual leading edge, against which the hot gases flow directly and which therefore requires especially careful cooling, and, on the other hand, the connecting points between the web 8 and the inner walls of the suction side 6 and the pressure side 7, which on no account are to be cooled too intensely.

However, with the aid of the ribs, which are known per se and are cast with the blade, in a novel arrangement and geometry, the invention, with one and the same measure, solves the prevailing problems in both regions.

Figure 2:
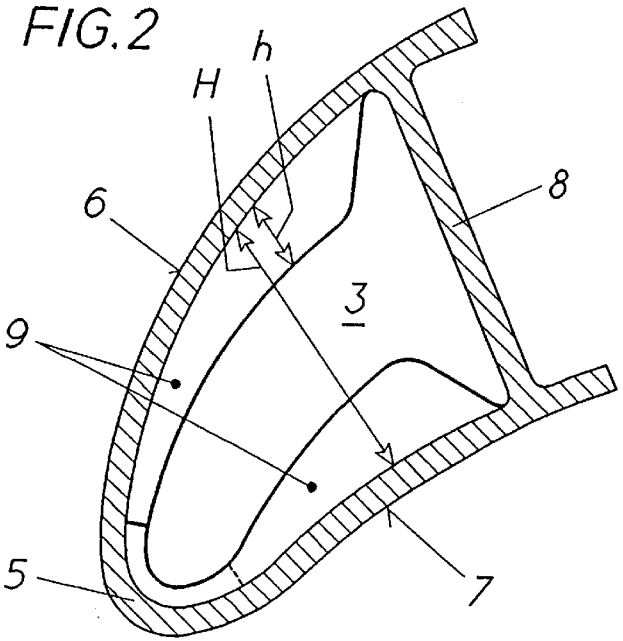
FIG. 2 shows the leading-edge region of the blade according to FIG. 1.
Figure 3:
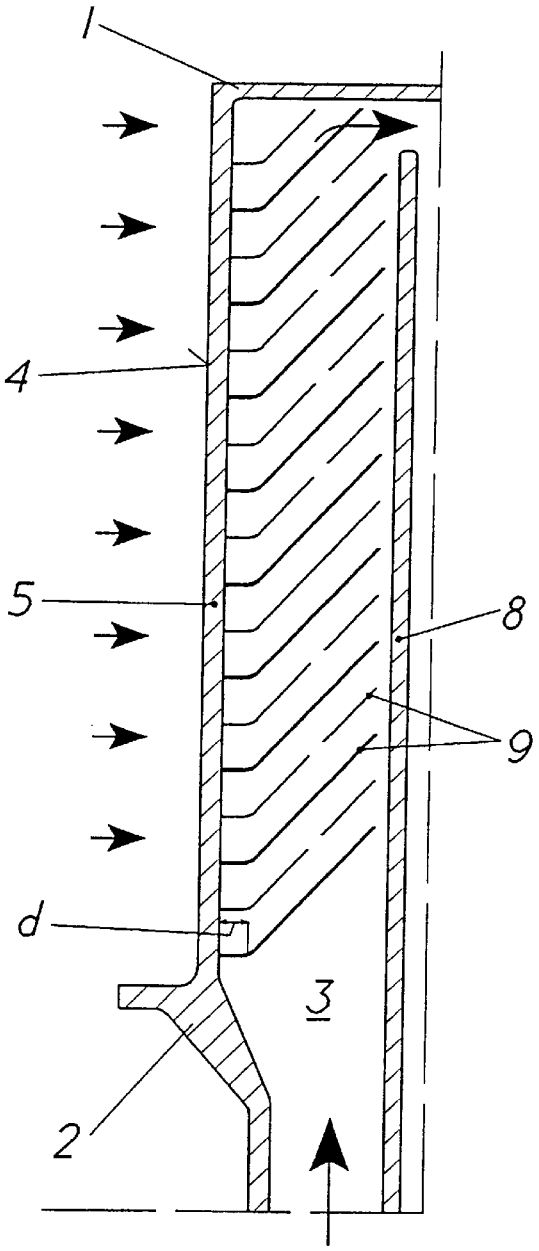
FIG. 3 shows a longitudinal section through the leading-edge region.

FIGS. 2 and 3 show the cooling system for the leading-edge region of a hollow gas-turbine blade. A duct 3, through which flow occurs longitudinally and which corresponds to the chamber a in FIG. 1, extends from the blade root 2 up to the blade tip 1. In the region of the blade body 4, this duct is defined by the inner walls of the leading edge 5, the suction side 6 and the pressure side 7 as well as by a web 8 connecting the pressure side to the suction side. The inner walls of the suction side and the pressure side are provided with a plurality of ribs 9, which run slantwise and at least approximately in parallel and are arranged so as to be staggered over the blade height. As can be seen from the schematic representation in FIG. 3, the suction-side ribs and the pressure-side ribs are offset from one another by half a spacing over the blade height.

To this extent, ribbed cooling systems are known. According to the invention, however, the ribs now run radially inward at an angle of 45° from the web 8 in the direction of the leading edge 5. It can be expected that setting angles of between 15° and 60° are suitable. In addition, the ribs merge into a radiused portion in the region of the leading edge. This deviation of the ribs from the slant into the radiused portion is effected with the smallest possible radius. It is also possible for the ribs to run slantwise into the leading edge and deviate in the process. This means that the shape of the ribs, for technical reasons related to the casting, then no longer have the same cross-sectional profile overall, but are "twisted" in the region of the sharply curved leading-edge wall. From this it follows that the distance d from the leading edge up to the location of the deviation may be between 0% and 15% of the length of the duct 3. The effect of these ribs set slantwise and their deviation is as follows:

The rib structure causes a secondary flow in the duct and this secondary flow conveys hot air from the immediate vicinity of the leading edge into the center of the duct. This hot air is replaced by colder air from the duct center.

Figure 4:
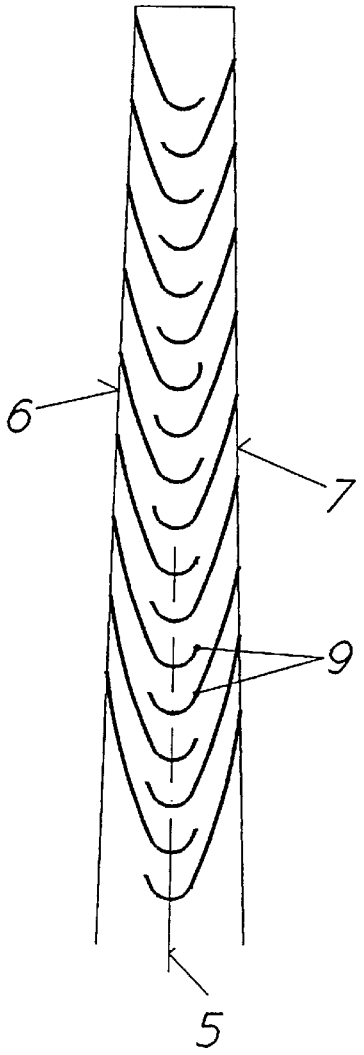
FIG. 4 shows a perspective schematic front view of the blade ribbing in the leading-edge region.

Furthermore, the deviated ribs are led all the way around the leading-edge region, as can be seen in FIGS. 2 and 4. This solution, together with the offset arrangement of the ribs on the suction side 6 and the pressure side 7, brings about the following:

Closer staggering of the ribs is produced in the leading-edge region than in the center region of the duct. This leads to a very pronounced stimulation of the heat transfer in this zone due to an increase in the turbulence and the generation of contact points of the flow behind recirculation zones, which develop behind the ribs.

The ratio of the height h of the ribs to the local height H of the duct 3 increases from the leading edge 5 in the direction of the web 8. In the example, this height increase is selected in such a way that a duct which is approximately of uniform width and through which flow occurs freely is produced between the leading edge and web in every axial plane. With this measure, a uniform distribution of cooling medium is achieved over the entire cross section through which flow occurs. The two mechanisms mentioned above for increasing the heat transfer do not become especially effective until a locally dependent rib height is introduced. In the duct, the locally dependent rib height creates a flow which also passes into the narrow leading-edge region, since the flow resistances here are now approximately the same magnitude as in the rest of the duct. Furthermore, the configuration of the novel ribs in the cooling passage has a very positive and stimulating effect on the abovementioned secondary flow in the duct, which secondary flow removes the air from the leading edge into the rear duct region. Here, the high ribs in the rear duct region induce a very intense secondary flow.

Under certain conditions, it is favorable, as has been verified experimentally, if the ratio of height h of the ribs to the local height H of the duct is constant over the longitudinal extent of the ribs.

As can be seen from FIG. 2, the height h of the ribs in the region of the web 8 decreases continuously toward zero. It goes without saying that connections which are sharp-edged due to manufacture are scarcely possible. As already mentioned, this configuration has the advantage that, at the connecting points between the web and the inner walls, the cooling medium flows virtually free of disturbance along the walls and thus develops less cooling effect. Of course, the intermediate web 8 must never become too hot. If this should occur on account of the configuration selected, it is easily possible to lead the ribs further up to the web with an adapted height, i.e. with the same height or a reduced height.

The height h of the individual ribs staggered over the blade height may of course be adapted to the thermal loading present locally. Enlargement of the ribs toward the blade tip is especially appropriate if the cooling medium has already heated up to a considerable extent on its way through the duct, so that the requisite temperature difference between the wall to be cooled and the cooling medium for the intended heat exchange becomes smaller.

Figure 5:
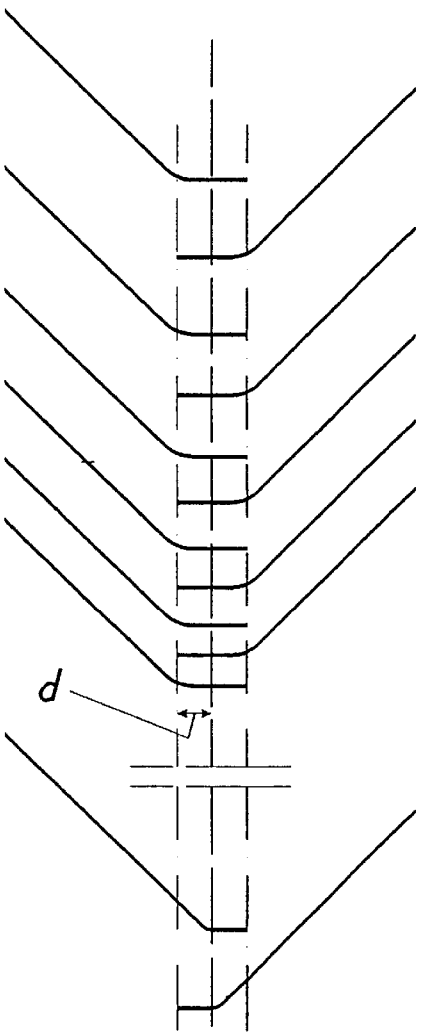
FIG. 5 shows a schematic developed view of the blade ribbing in the leading-edge region.

A similar effect can be achieved by varying the distance between the ribs over the blade height. Of course, both measures may also be combined. Such a variable distance is illustrated schematically in FIG. 5. In the top part, the distance between the ribs becomes increasingly larger toward the blade tip. Shown in the bottom part is the solution in which the slant runs directly into the leading edge, i.e. the distance d referred to is 0 here.

Accordingly, under given conditions—i.e. geometry and wall thickness of the leading edge and the lateral walls; geometry of the chamber a through which the cooling medium is to flow; thermal loading of the leading edge of the blade; type, temperature and flow velocity of the cooling medium—the selection of the rib setting angle, the local height of the ribs projecting into the duct through which flow occurs, and the number and the spacing of the ribs staggered at the radial over the blade height are decisive for constant metal temperatures over the blade height.

Obviously, numerous modifications and variations of the present invention are possible in light of the above teachings. It is therefore to be understood that, within the scope of the appended claims, the invention may be practiced otherwise than as specifically described herein.

What is claimed is:

1. A cooling system for the leading-edge region of a hollow gas-turbine blade, comprising:

a hollow blade including a blade body, a blade root, a blade tip, a leading edge having a radiused portion, a suction side, a pressure side, a web connecting the pressure side to the suction side, a duct through which a cooling medium can be caused to longitudinally flow from the blade root to the blade tip, the duct being defined in the blade body by the inner walls of the leading edge, the suction side, the pressure side and the web, the inner walls of both the suction side and the pressure side being provided with a plurality of ribs which run slantwise and at least approximately in parallel, the suction-side ribs and the pressure-side ribs being alternatingly and longitudinally offset from one another, wherein each of the ribs includes a first portion which runs from the web in the direction of the leading edge and a second portion which merges into the first portion in the region of the leading edge, the second portion extending around the leading edge radiused portion.

2. The cooling system according to claim 1, wherein the transition of each of the ribs from the first portion into the second portion is effected with the smallest possible radius.

3. The cooling system according to claim 1, wherein the distance (d) from the leading edge to the location of the transition is between 0% and 15% of the length of the duct.

4. The cooling system according to claim 1, wherein the height (h) of the ribs increases from the leading edge in the direction of the web.

5. The cooling system according to claim 1, wherein the ratio of the height (h) of the ribs to the local height (H) of the duct is constant over the longitudinal extent of the ribs.

6. The cooling system according to claim 1, wherein the height (h) of the ribs decreases in the region of the web.

7. The cooling system according to claim 1, wherein the height (h) of the ribs is variable over the blade height.

8. The cooling system according to claim 1, wherein the spacing between the ribs is variable over the blade height.

9. The cooling system according to claim 1, wherein the second portions of adjacent ribs longitudinally overlap.

* * * * *